US005862062A

United States Patent [19]

Smyrl et al.

[11] Patent Number: 5,862,062

[45] Date of Patent: Jan. 19, 1999

[54] PARALLEL PROGRAMMING OF A PLURALITY OF NODES IN A COMMUNICATION NETWORK

[75] Inventors: Clifford G. Smyrl, St. Paul; Doulgas G. Knight, Minneapolis, both of Minn.

[73] Assignee: New York Air Brake Corporation, Watertown, N.Y.

[21] Appl. No.: 713,842

[22] Filed: Sep. 13, 1996

[51] Int. Cl.[6] ..... G06F 9/00; G06F 13/00

[52] U.S. Cl. ..... 364/578

[58] Field of Search ..... 364/578; 701/2, 701/19, 20; 395/21, 200.31; 340/825.06

[56] References Cited

U.S. PATENT DOCUMENTS

| | | | |
|---|---|---|---|
| 4,181,943 | 1/1980 | Mercer, Sr. et al. | 701/20 |
| 5,429,329 | 7/1995 | Wallace et al. | 246/166 |
| 5,564,657 | 10/1996 | Dimsa et al. | 246/187 |
| 5,583,769 | 12/1996 | Saitoh | 701/79 |
| 5,681,015 | 10/1997 | Kull | 246/187 C |

OTHER PUBLICATIONS

Echelon Engineering Bulletin, 005–0025–01 Rev. A, dated Apr., 1993.

Motorola Application Note 12511: Programming the MC143120 Neuron Chip, in Motorola's LonWorks technology device on pp. AL421–439 and Appendix B, pp. 9–33, 1995.

*Primary Examiner*—Kevin J. Teska
*Assistant Examiner*—Ayni Mohamed
*Attorney, Agent, or Firm*—Barnes & Thornburg

[57] ABSTRACT

A communication network having a plurality of nodes and a controller, a plurality of intermediate nodes in communication on a one-to-one basis with the plurality of first target nodes to be programmed. A first file containing a first executable program is transferred in parallel to each of the intermediate nodes. Intermediate nodes then, in parallel, program a respective first target node. The intermediate nodes may begin programming a respective first target node upon receipt of a sufficient portion of the first file to initiate programming or may begin upon receiving the complete first file. The intermediate nodes may also have connected thereto a respective second target node and may program the second plurality of target nodes simultaneously and in parallel using either the first file already transferred or a second file containing a second executorial program transferred in parallel.

26 Claims, 5 Drawing Sheets

PARALLEL PROGRAMMING OF A PLURALITY OF NODES IN A COMMUNICATION NETWORK

BACKGROUND AND SUMMARY OF THE INVENTION

The present invention is directed in general to programming nodes in a communication network and more specifically to the parallel program of nodes in the communication network.

With the addition of electro-pneumatically operated train brakes to the railroad freight train, there is a need to provide a communication network between the locomotive and each of the cars of the freight train. Each car includes one or more nodes of the communication network providing for communication and control of the electro-pneumatic brake as well as monitoring functions of other operations at the individual cars. A freight train may have, for example, 100 or more cars and thus, the network would need a minimum of 100 or more nodes in addition to the nodes on one or more of the locomotives. The American Association of Railroads has selected as a communication architecture, for the electric-pneumatic (EP) systems, LonWorks by Echelon. Each car includes a Neuron chip as a communication node in this design. The network and the nodes are interconnected by power and communication trainlines, either over a common power and communication line or over separate power and communication lines.

The consist of the freight train, including one or more locomotives and a plurality of cars, continuously varies as to the length of the train and the cars which make up the train. Similarly, in a single train, the environment in which it is travelling may vary. Thus, it is very beneficial to provide the ability to reprogram the individual nodes, to change the operating parameters or parameters monitored. This requires a reprogram of the individual nodes. The present design of the LonWorks hardware and software requires each of the nodes to be individually programmed one at a time. Thus, the programming of the nodes or a subset of similar nodes, would require an extensive amount of time. This will either require downtime of the whole freight train, or a lack of monitoring and brake control over one or more of the cars while the train is moving. Thus, it limits the amount of reprogramming which can be conducted or requires down time of the train or individual cars. Thus, there exists a need of a method and system for more efficiently and safely reprogramming nodes in a communication network.

Thus, it is an object of the invention to provide a method and apparatus for parallel programming of nodes in the communication network.

Another object of the present invention is to provide an efficient and safe method and apparatus for programming nodes in a communication network.

These and other objects are achieved by providing, in a communication network having a plurality of nodes and a controller, a plurality of intermediate nodes in communication on a one-to-one basis with the plurality of first target nodes to be programmed. A first file containing a first executable program is transferred in parallel to each of the intermediate nodes. Intermediate nodes then, in parallel, program a respective first target node. The intermediate nodes may begin programming a respective first target node upon receipt of a sufficient portion of the first file to initiate programming or may begin upon receiving the complete first file. The intermediate nodes may also have connected thereto a respective second target node and may program the second plurality of target nodes simultaneously and in parallel using either the first file already transferred or a second file containing a second executorial program transferred in parallel. If the first and second target nodes are the same type, the common program can be used and if not, two separate executorial programs must be used.

The network in the preferred embodiment is a LonWorks network where each of the nodes are Neuron based nodes. With the presently available hardware, flash memory is provided to each target node to allow reprogramming. The programming of the target nodes in parallel is performed asynchronously. Preferably, the controller is on one of the locomotives of a train and one or more nodes are on the individual cars of the train.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
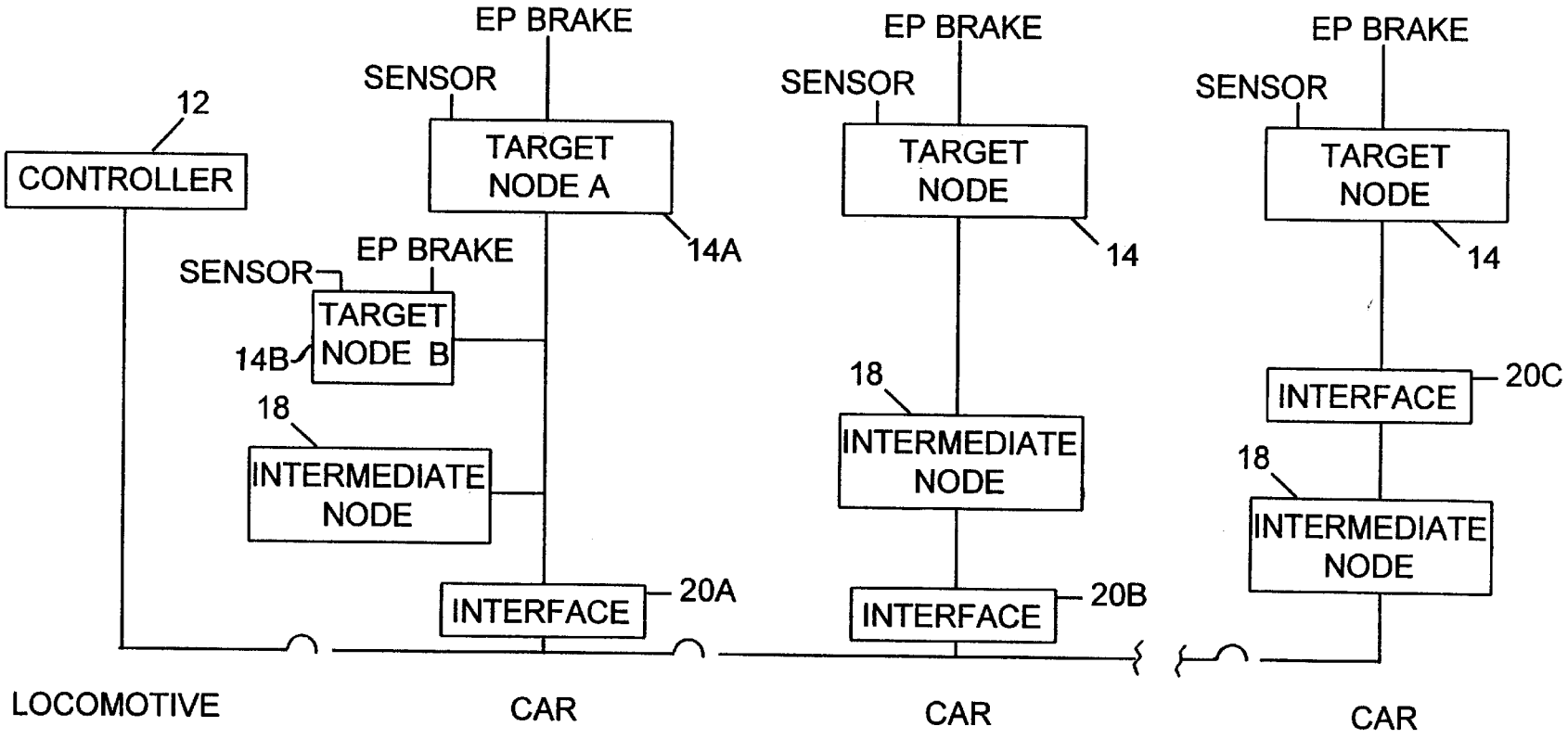
FIG. 1 is a schematic representation of a communication network in a train according to the principles of the present invention.

A communication network 10 in the train is illustrated in FIG. 1. A controller 12 is provided at one of one or more of the locomotives and a communication node known as a target node 14 is provided in each of the cars. A train power and/or communication line 16 is shown interconnecting the locomotive and the cars and forms the connection for the communication network. The network preferably is a LonWorks communication network by Echelon wherein each of the nodes, as well as the controller includes at least a Neuron chip. The target nodes 14 on each of the cars preferably controls the electro-pneumatic brakes and controls or monitors one or more sensors. Each car may have two target terminals of the same or different types. This is shown for the first car in FIG. 1 which has target nodes 14A and 14B. The structure of the LonWorks communication network is well-known and need not be provided in detail. The controller 12 can communicate with each of the nodes 14 either individually or as groups. Data and commands are transferred between the various nodes on the network.

In a general network, the controller 12 is capable of reprogramming any of the individual nodes 14 on a one-to-one basis. In order to allow parallel programming, intermediate nodes 18, as Neuron chips, are provided at each car. The intermediate node 18 is connected to the trainline 16 to receive data from the controller 12 and is also connected to respective target nodes 14 on a one-to-one basis. An interface 20 is provided on each car to allow communication between the controller 12 and the target nodes 14 directly or through the intermediate node 18. The interface 20 also can control the communication between the intermediate node 18 and the controller 12 or the target node 14.

Interface 20A allows direct communication between the controller 12 and the target nodes 14A and 14B.

Interface 20A may be a gateway, a Neuron with a special Microprocessor Interface Program (MIP) in the firmware, a bridge, a router, a repeater or a switch. Alternatively, the communication with a target node 14 may be only through the intermediate node 18. This is illustrated by interface 20B being between the communication line 16 and the intermediate node 18 or interface 20C which is between the intermediate node 18 and the target node 14. In these cases, the interface 20B and 20C would either be a MIP or a gateway. The intermediate node 18 may be part of the interface 20B or 20C.

With the present day technology, the interface circuit 20 is desirable, otherwise messages transmitted on the trainline 16, while the intermediate nodes are programming the various target nodes, would clog up the network. Thus, the interface 20 is not necessary for the theoretical operation of the system. The interface 20A provides a parallel communication between the controller and the target node 12 and the intermediate node 18 whereas interfaces 20B and 20C provide serial communication between the controller 12 and the target node 14 and intermediate node 18. These references are to signal processing, not signal connection or porting.

As will be explained more fully below, the controller 12 transmits as a data package or file including an executable program, in parallel to each of the intermediate nodes 18 for a specific group of target nodes 14. The intermediate nodes 18 then individually and simultaneously program their respective target nodes 14. In order to allow the parallel processing, the target nodes 14 for the particular transferred executable program must be of the same type so as to be reprogrammed by the same program simultaneously. The intermediate nodes 18 are capable of initiating the program upon receipt of sufficient portion of the data file or upon receipt of the complete data file, including the executable program. The parallel reprogramming of the target nodes 14 by their respective intermediate nodes 18 is carried out in parallel and preferably, asynchronously or independently.

Figure 2:
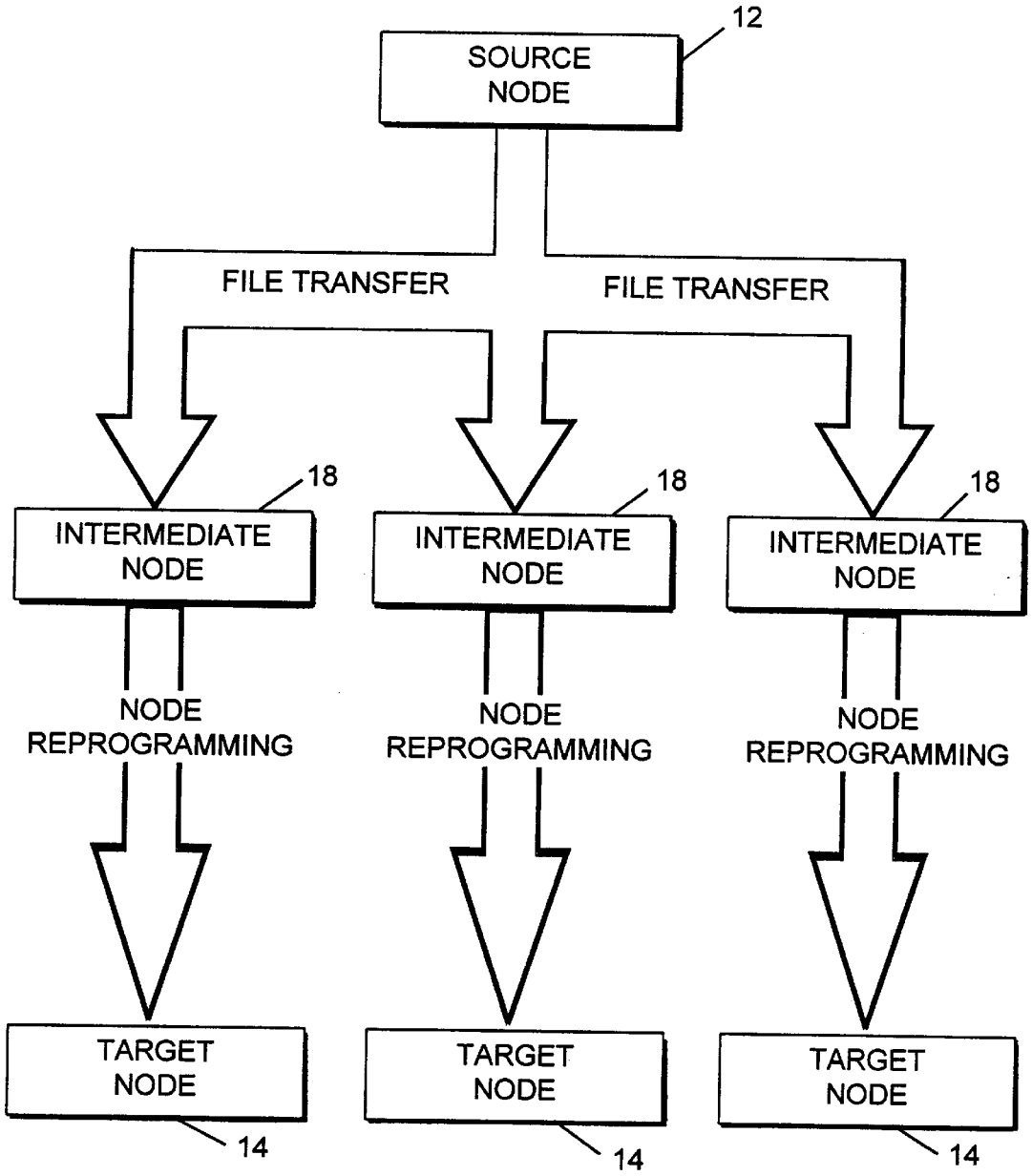
FIG. 2 is a schematic representation of the data flow for a first embodiment of the present invention.

The particular data flow is illustrated in FIG. 2. The source node 12 is, for example, at the locomotive controller 12. Alternatively, the source node may be at a different location. As illustrated in the flow chart of FIG. 2, the source node 12 transfers the file to the intermediate nodes 18 which then reprogram their respective nodes.

Figure 3:
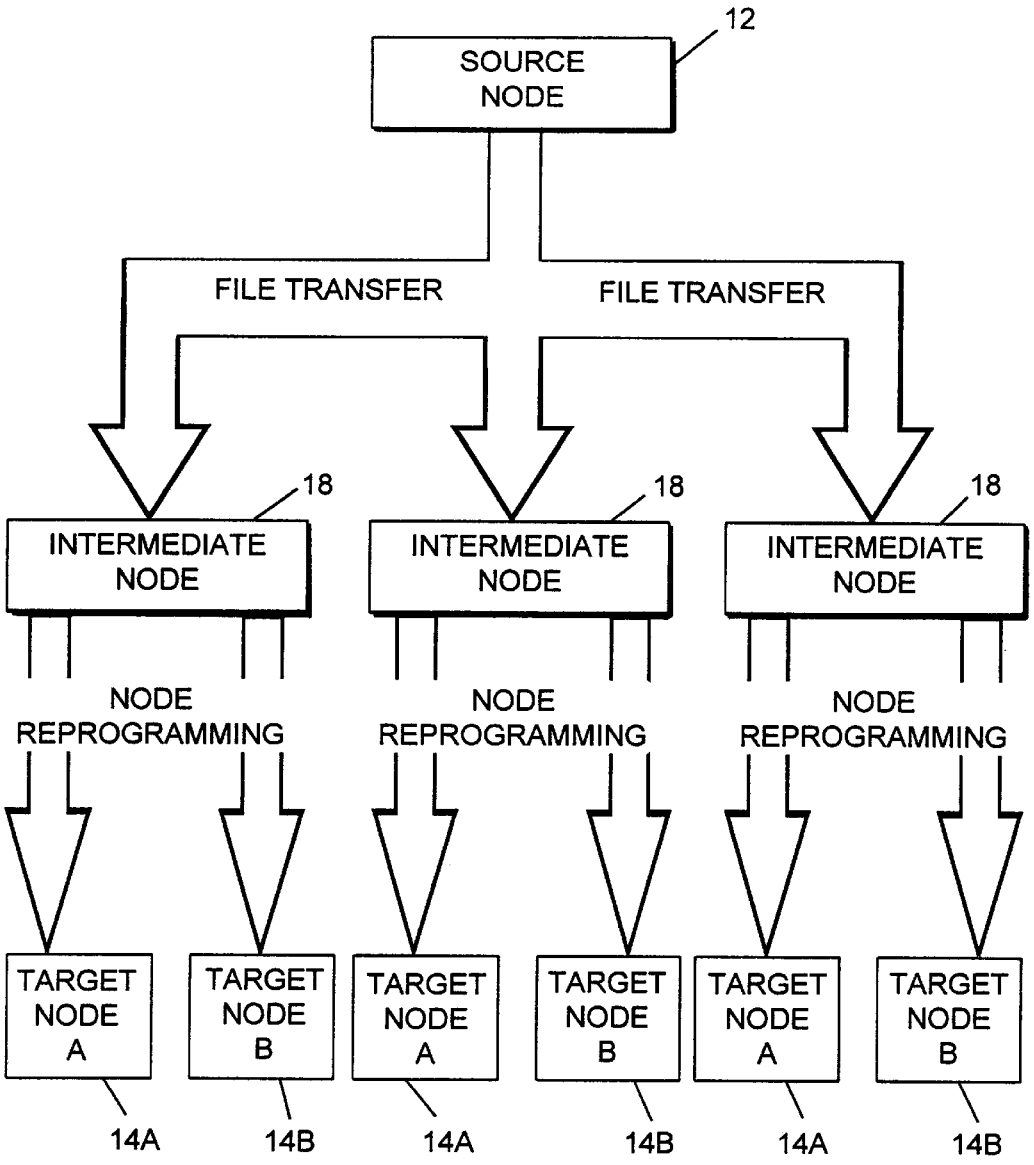
FIG. 3 is a schematic of the data flow according to a second embodiment of the present invention.

As a further embodiment illustrated in FIG. 3, the individual intermediate nodes 18 may include a type A and type B node connected thereto. Thus, the intermediate node 18 could simultaneously and in parallel reprogram their respective nodes 14A using the first executable program from the first file. Subsequently, the intermediate nodes 18 may in parallel and simultaneously, using the same first executable program, program target nodes 14B if target node A and target node B are of the same type. Alternatively, the intermediate node 18 may receive a first executable program for target node A and reprogram target node A and subsequently receive a second file including a second executable program for programming target node B.

It should be noted with the present hardware available for LonWorks, the target nodes 14 must include or have added a flash memory or equivalent device to allow network based node reprogramming.

Figure 4:
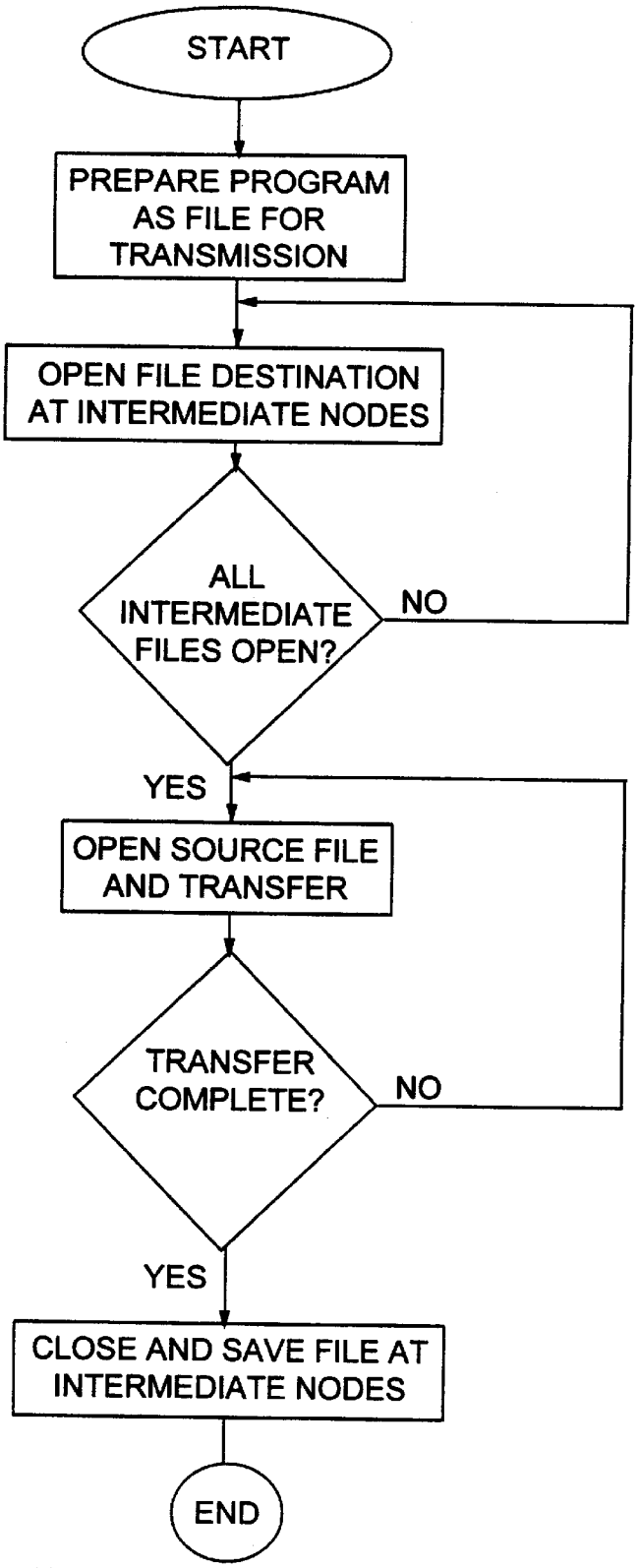
FIG. 4 is a flow chart of the file transfer.

The source node 12 prepares the executable program in file form to be transferred to the intermediate nodes 18. As described in *Echelon Engineering Bulletin*, 005-0025-01 Rev. A, dated April, 1993, the file transfer takes place by transferring the data in a plurality of packets containing, for example, 32 bytes of data. A flow chart is illustrated in FIG. 4. A source node 12 may be considered not only the initiator, but the sender, according to the file transfer. This windowed transfer protocol is to send the data packets with an unacknowledged service and with a request/response packet sent every six packets. This avoids the overhead of acknowledging every packet, but allows recovery of a lost packet, no more than six packets later.

The source node of the controller 12 begins by opening the destination files at the appropriate intermediate node 18 to receive or be written into. Once controller 12 receives acknowledgement that the files are open for writing, controller 12 then uses the same procedure to open the source file to be read onto the communication trainline 16 with the appropriate address of the intermediate nodes 18. At the conclusion of the transfer, after acknowledgement has been sent, controller 12 then closes and saves the files in the intermediate nodes 18.

Control of the nodes, recycling and retransmission for errors are described in the previously referenced engineering bulletin and references made thereto and incorporated herein. The file transfer has the capability of transferring a single file from a single source to a plurality of receivers being one or more of the intermediate nodes 18. Thus, this process is carried out in parallel.

Figure 5:
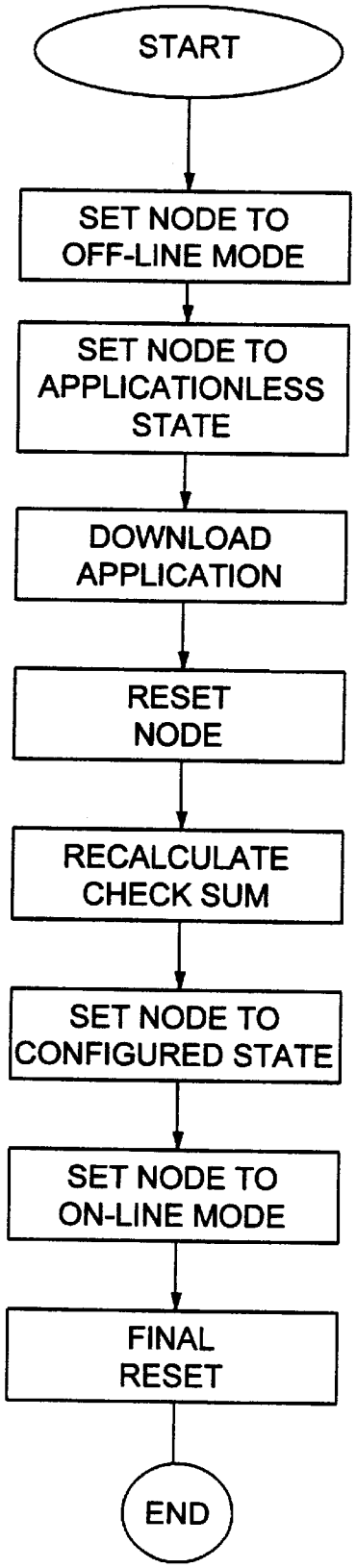
FIG. 5 is a flow chart of the reprogramming of the node.

The programming of a target node 14 by its respective intermediate node 18 begins by taking the node off-line as illustrated in the flow chart of FIG. 5. This places the application in an off-line mode. Next, the state of the node is altered to an applicationless state. If the node should have gone bypass off-line, then the node is reset.

Next, the application from the intermediate node 18 is downloaded into the target node 14. This is performed by a sequence of write memory commands which are determined by the executable program received by the intermediate node 18.

Once the application has been downloaded, the target node 14 is reset and its check sum is recalculated. The target node 14 is then set to the configured state and the node is set to an on-line mode. A final reset is then performed. A specific program for reprogramming an MC143120 Neuron chip is described in *Motorola Application Note* 1251*: Programming the MC*143120 Neuron Chip, in Motorola's LonWorks technology device on pages AL421–439 and Appendix B, Page 9–33. Although this application note was specifically for a 3120 Neuron Chip, minor modifications also make it applicable to the 3150 Neuron Chip.

Thus, it can be seen by using a file transfer routine to transfer executable programs to a specially provided intermediate node, parallel transfer of information and parallel programming of target nodes may be achieved in a communication network. This substantially reduces the amount of time it takes for reprogramming. The requirement is necessitated in a railroad requirement because of the number of nodes that occur in the network, the repetition of the types of nodes throughout the network and a requirement to reprogram. The present invention is also applicable to other communication networks.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A method of parallel programming a plurality of nodes on cars of a train and in a communication network of the with a controller comprising:

providing a plurality of intermediate nodes on the cars in communication on a one to one basis with a plurality of first target nodes to be programmed on the cars;

transferring in parallel to each of said intermediate nodes a first file containing a first executable program; and programming in parallel each first target node using said first program in a respective intermediate node.

2. A method according to claim 1 wherein each intermediate node begins programming a respective first target node upon receipt of a sufficient portion of said first file to initiate programming.

3. A method according to claim 1 wherein each intermediate node begins programming a respective first target node upon receipt of a complete first file.

4. A method according to claim 1 including:

providing a plurality of second target nodes to be programmed in the communication network on a one to one basis with the plurality of intermediate nodes;

transferring in parallel to each of said intermediate nodes a second file containing a second executable program; and programming in parallel each second target node using said second program in a respective intermediate node.

5. A method according to claim 4, wherein said plurality of first target nodes are of a first type and said plurality of second target nodes are of a second type different from said first type.

6. A method according to claim 4, wherein said plurality of first and second target nodes are of a first type.

7. A method according to claim 1, wherein said network is an LonWorks network and said nodes are Neuron based nodes.

8. A method according to claim 1, including providing a flash memory at each target node.

9. A method according to claim 1, including:

providing a plurality of second target nodes to be programmed in the communication network on a one to one basis with the plurality of intermediate nodes; and programming in parallel each second target node using said first program in a respective intermediate node.

10. A method according to claim 1, wherein said programming in parallel of said target nodes is asynchronous.

11. A communication network in a train having cars comprising:

a plurality of first target nodes on the cars to be programmed;

a plurality of intermediate nodes on the cars in communication network on a one to one basis with said first target nodes to be programmed; and a controller programmed to transfer in parallel to each of said intermediate nodes a first file containing a first executable program; and said intermediate nodes programming in parallel a respective first target node using said first program in said respective intermediate node.

12. A network according to claim 11 wherein each intermediate node begins programming a respective first target node upon receipt of a sufficient portion of said first file to initiate programming.

13. A network according to claim 11 wherein each intermediate node begins programming a respective first target node upon receipt of a complete first file.

14. A network according to claim 11 including:

a plurality of second target nodes to be programmed in communication on a one to one basis with the plurality of intermediate nodes;

said controller transfers in parallel to each of said intermediate nodes a second file containing a second executable program; and said intermediate nodes programs in parallel a respective second target node using said second program in said respective intermediate node.

15. A network according to claim 14, wherein said plurality of first target nodes are of a first type and said plurality of second target nodes are of a second type different from said first type.

16. A network according to claim 14, wherein said plurality of first and second target nodes are of a first type.

17. A network according to claim 11, wherein said network is an LonWorks network and said nodes are Neuron based nodes.

18. A network according to claim 11, including a flash memory at each target node.

19. A network according to claim 11 including:

a plurality of second target nodes to be programmed in communication on a one to one basis with the plurality of intermediate nodes; and said intermediate nodes programs in parallel a respective second target node using said first program in said respective intermediate node.

20. A network according to claim 11, wherein said intermediate nodes program said target nodes in parallel asynchronously.

21. A network according to claim 11, including a plurality of interfaces connecting said controller to a respective target and intermediate nodes in parallel for communication between said controller and said target and intermediate nodes directly.

22. A network according to claim 11, including a plurality of interfaces connecting said controller to a respective target and intermediate nodes in series for communications between said controller and said target node through said intermediate node.

23. A method of parallel programming a plurality of Neuron based nodes in a LonWorks communication network with a controller comprising:

providing a plurality of intermediate Neuron based nodes in communication on a one to one basis with a plurality of first target Neuron based nodes to be programmed;

transferring in parallel to each of said intermediate nodes a first file containinga first executable program; and programming in parallel each first target node using said first program in a respective intermediate node.

24. A method according to claim 23, wherein said controller is on a locomotive of a train and said nodes are on cars of said train.

25. A LonWorks communication network comprising:

a plurality of first target Neuron based nodes to be programmed;

a plurality of intermediate Neuron based nodes in a LonWorks communication network on a one to one basis with said first target nodes to be programmed; and a controller programmed to transfer in parallel to each of said intermediate nodes a first file containing a first executable program; and said intermediate nodes programming in parallel a respective first target node using said first program in said respective intermediate node.

26. A network according to claim 25, wherein, wherein said controller is on a locomotive of a train and said nodes are on cars of said train.

* * * * *